US006058361A

United States Patent [19]

Mainard

[11] Patent Number: 6,058,361

[45] Date of Patent: May 2, 2000

[54] TWO-STAGE HIERARCHICAL SUBBAND CODING AND DECODING SYSTEM, ESPECIALLY FOR A DIGITIZED AUDIO SIGNAL

[75] Inventor: Laurent Mainard, Rennes, France

[73] Assignees: France Telecom SA; Telediffuson De France SA, both of Paris, France

[21] Appl. No.: 09/155,168

[22] PCT Filed: Apr. 2, 1997

[86] PCT No.: PCT/FR97/00582

§ 371 Date: Apr. 27, 1999

§ 102(e) Date: Apr. 27, 1999

[87] PCT Pub. No.: WO97/38417

PCT Pub. Date: Oct. 16, 1997

[30] Foreign Application Priority Data

Apr. 3, 1996 [FR] France ..... 96 04483

[51] Int. Cl.[7] ..... G10L 19/02

[52] U.S. Cl. ..... 704/220; 704/205; 704/211; 704/221

[58] Field of Search ..... 704/205, 211, 704/220, 221

[56] References Cited

U.S. PATENT DOCUMENTS

| | | | |
|---|---|---|---|
| 4,956,871 | 9/1990 | Swaminathan | 704/229 |
| 5,495,552 | 2/1996 | Sugiyama | 704/201 |
| 5,630,010 | 5/1997 | Sugiyama | 704/201 |

OTHER PUBLICATIONS

Grant Davidson and Allen Gersho, "Multiple–Stage Vector Excitation Coding of Speech Waveforms," Proc. IEEE ICASSP 88, p. 163–166, Apr. 1988.

Bernhard Grill and Karlheinz Brandenburg, "A Two– or Three–Stage Bit Rate Scalable Audio Coding System," Proc. 99th Convention of the Audio Engineering Society, preprint 4132, p. 1–8, Oct. 1995.

*Primary Examiner*—David R. Hudspeth
*Assistant Examiner*—Tālivaldis Ivars Šmits
*Attorney, Agent, or Firm*—Laff, Whitesel & Saret, Ltd.; J. Warren Whitesel

[57] ABSTRACT

A coding system delivers a global data stream consisting of primary coded subband data streams from a primary subband coder bank, coding an input signal data stream, and secondary coded subband data streams from a secondary subband coder bank. The coding delay of the primary coder bank is smaller than that of the secondary coder bank. A filter bank receives the input signal data and generates signal streams in a plurality of subbands, which are coded by the respective coder of the primary subband coder bank, forming the primary streams. A bank of decoders receive and decode the respective coded primary subbank streams, which decoded subband signals are subtracted by a bank of subtractors from the corresponding original subband signals, which difference streams are input to the respective coder in a secondary subband coder bank. The secondary coder generates coded secondary subband data streams. A multiplexer interlaces the primary and the secondary coded subband data streams into a single global data stream.

10 Claims, 3 Drawing Sheets

TWO-STAGE HIERARCHICAL SUBBAND CODING AND DECODING SYSTEM, ESPECIALLY FOR A DIGITIZED AUDIO SIGNAL

FIELD OF INVENTION

The present invention relates to a system for the coding and decoding of a signal, especially of an audio-numerical digitized audio signal. These systems find their application in the slow thruput transmission of sound signals, with coding/decoding delay constraint as low as possible, imposed for example by the return of a control voice.

BACKGROUND OF THE INVENTION

During the transmission of digitized signals, the latter are numerically coded in the transmitter, then decoded in a receiver for their reproduction. The present invention deals with the antinomy between on the one hand, the search for a transmission quality that generally brings about, for a set rate of thruput, a relatively long coding and decoding delay and, on the other hand, the coding and decoding delay that, in some applications must be short.

In the present description, there is called coding/decoding delay the time length that separates the input of a sample into the coding device from the output of the corresponding sample at the decoding device. In order to be free from the particular execution of the coding process and/or from the structure of the circuits permitting this coding, it will be considered that the computations done at the time of these processes are infinitely fast in the coding as well as in the decoding machine. There are thus involved, in the computations of the coding/decoding time lag, only parameters such as the length of time for of acquiring numerical signal rasters, the delay imposed by a filter bank, and/or the time corresponding to a multiplexing of the samples.

In the case of a transform-type coding device, this delay will exceed the duration of a coded raster added to the delay developed by the transform. In the case of a low-delay coding device of the LD-CELP type, such as that described by J. H. Chen et al in the article titled "A low delay CELP coder for CCITT 16 kb/s speed coding standard", published in IEEE J. Sel. Areas Commun. Vol. 10, pp 830–849, the delay is linked to the five samples that constitute a basic raster. It will be noted that a coding diagram has a delay expressed in number of samples. In order to extract from this a time value, there must be brought into play the sampling frequency at which the coder is used, according to the relation:

$$\text{time duration} = \text{delay in samples}/\text{sampling frequency}$$

As for the coding quality, this is a parameter difficult to define, knowing that the final receiver, that is to say the hearer's ear, cannot give precise quantitative results. Furthermore, measurements such as that of the signal to noise ratio, are not relevant because they do not take into account the psycho-acoustical masking properties of the auditory system. Statistical techniques such as those recommended by the notice ITU-R-BS-1116, permit to separate different coding algorithms with respect to coding quality.

It will be noted, however, that an improvement of the signal to noise ratio achieved on the frequency aggregate of the sound signal, makes it possible to ensure an improvement of the perceived quality.

The coding systems of generic audio-numerical signals, that is to say without hypothesis regarding the mode of production of these signals, until now, have not seriously considered as a constraint the matter of the signal reconstruction delay. One exception however is illustrated by the process described by F. Rumseyi in the article titled "Hearing both sides-stereo sound for TV in the UK" published in IEE review, vol. 36, No. 5, pp 173–176. In this process, however, the compression levels reached do not permit to compete with the coders with classical transforms.

Among the algorithms that are standardized by ISO (ISO/IEC 13818-3) the minimal reconstruction delays range from 18 ms for the simplest coder—and therefore the least efficient one—to more than 100 ms for the most complex coder. Other coding processes not standardized by ISO, such as the so-called ASPEC (Adaptative Spectral Perceptual Entropy coding) process described by K. Brandenburg et al, or the so-called ATRAC process (Adaptative Transform Acoustic Coding) described by K. Tsutsui typically present coding/decoding delays of the order of approximately one hundred milliseconds.

The efficiency of the coding system is bound to the side of the filterbanks that are generally used, to the taking into account the long term redundancies in the signals to be coded, to the optimal distribution of the binary allocations over a duration longer than the raster, etc. Taking into account these elements at coding time has as a consequence to increase the delay of the coding/decoding system.

It will be noted that the low delay coders often are related to the speech coding for telephone duplex connections, for example, or to be associated with echo cancelers. Designed most often for sample frequencies of 8 kHz to 16 kHz, their quality level proves insufficient to code generic audio-numerical signals in a manner close to the original.

The purpose of the present invention is to propose, within this context, a coding system and the associated decoding system, that permits the receiving side simultaneously to reconstruct a quality audio-numerical signal, and a lesser quality audio-numerical signal with a coding/decoding delay of which is as low as possible.

Such a coding/decoding system is already known and there must be mentioned the Preprint 4132 of the 99th AES Convention of October 1995 in New York, at which Bernhard Grill et al describe hierarchical audio-numerical coding systems, that is to say systems the output bit flow of which comprises a sub-group of bits that may permit a decoding and reconstitution of a significant or pertinent sound signal, but with a low quality compared to that obtained by decoding and reconstitution of the total bit flow.

Such coding systems comprise a coder to code a high quality sound signal the output of which is connected to the input of a decoder, and a difference circuit that performs the difference between the signal obtained at the output of the decoder and the original signal. The difference signal itself is subject, in a second stage, to similar coding, decoding, and difference computation treatments. The third stage codes the difference residual signal. The signals coming out of the coders of the three stages then are multiplexed so as to form a hierarchical numerical flow. Several modes of execution are presented, one of which specifies that, in the first stage, the coder is a low bit output coder with a relatively low coding delay. The coder of the second stage, however, is a longer delay coder.

With such a system there are thus available three flows multiplexed into a single output flow, one of these flows being developed with the low delay coder presenting a low delay and a lower quality level, while the other two show higher delays but bring in the flow of information necessary to a high quality reproduction.

In the systems presented by Bernhard Grill, however, each coder is, in reality, constituted by a under-sampled filterbank and a coder. Likewise, each decoder in reality is made up of a decoder, of a filterbank associated with the filterbank of the coder and that is over-sampling. It has been possible to observe that the use of such coders and decoders in this particular structure still brings about a relatively high coding/decoding delay of the low quality flow.

SUMMARY OF THE INVENTION

The purpose of the present invention is to propose a coding with a coding/decoding delay of the low quality flow that is inferior to (i.e., less than) that given by the above-described system.

To that end, a coding system according to the invention is characterized in that it comprises a filterbank provided to receive the input flow to be coded, and to develop signals in primary coders, in order respectively to code these signals in sub-bands and thus form the primary flows; the decoders to receive these primary flows and that decode them; the subtractors each one of which is provided to perform the difference between the signals delivered by the filterbank in a sub-band, and the signals issued from the corresponding decoder; a coder called secondary coder, to perform the coding of the signals issued from the subtractors, and thus develop the secondary flow; and a multiplexer to multiplex into a single global flow the primary flows issued from the primary coders and the secondary flow issued from the secondary coder.

It further comprises a second filterbank called secondary filterbank that receives on each one of its inputs the difference signals issued from a subtractor and that delivers a filtered flow to the input of the secondary coder. Said secondary filterbank advantageously comprises, for each sub-band, an input to receive the primary flow issued from the primary coder and to decode it by the corresponding decoder to determine, by means of a psycho-acoustical model, the maximal levels of noise that can be injected into each one of the sub-bands, said secondary coder being a perceptual coder the coding of which is based on the psycho-acoustical analysis performed by said secondary filterbank.

According to a variant in execution of the invention, the above secondary filterbank comprises, for each sub-band, an input to receive the signal in sub-bands that came from the primary filterbank, in order to determine, by means of a psycho-acoustical model, the maximal levels of noise that can be injected into each one of the sub-bands, the above-mentioned secondary coder being a perceptive coder the coding of which is based on the psycho-acoustical analysis done by the above secondary filterbank.

Advantageously, each primary coder is a coder that can be reconfigured in flow.

The present invention also relates to a multiplexing process of a primary raster with a secondary raster developed by a coding system for a signal to be coded, of the type delivering a global flow formed of a primary flow corresponding to a coding of an incoming flow, called primary coding, and of a secondary flow corresponding to a secondary coding.

It consists in forming a raster called global raster made up by the assembling in chain form of a plurality of primary rasters and of a plurality of fragments of at least one secondary raster, one primary raster alternating with one fragment of a secondary raster, the number of bits in a secondary raster fragment being equal to the rate of flow assigned to the secondary flow multiplied by the transmission time of a primary raster. The transmission of the global rasters advantageously is done for all the durations of the primary rasters. Likewise, the duration of a global raster is equal to the transmission duration of a primary raster multiplied by the number of primary rasters.

The present invention also relates to a system for the decoding of a flow coded by a coding system such as that described above. It comprises a de-multiplexer that delivers a plurality of primary flows, and one secondary flow, a plurality of primary flow decoders to decode these primary flows, the output of each decoder being connected to a corresponding input of a bank of primary filterbank that then deliver a low delay decoded flow, the output of each decoder being also connected to an input of a corresponding delay line the output of which is connected to the first input of a summing-up device, a secondary decoder delivering a decoded secondary flow supplied to a second input of each summing-up device, the output of each summing-up device being connected to the input of a secondary filterbank to deliver a high quality decoded flow. It further comprises a secondary filterbank.

The above-mentioned characteristics of the invention, as well as others, will appear more clearly upon reading of the following description of an example of execution, this description being given with reference to the attached drawing, in which:

DETAILED DESCRIPTION OF THE INVENTION

Figure 1:
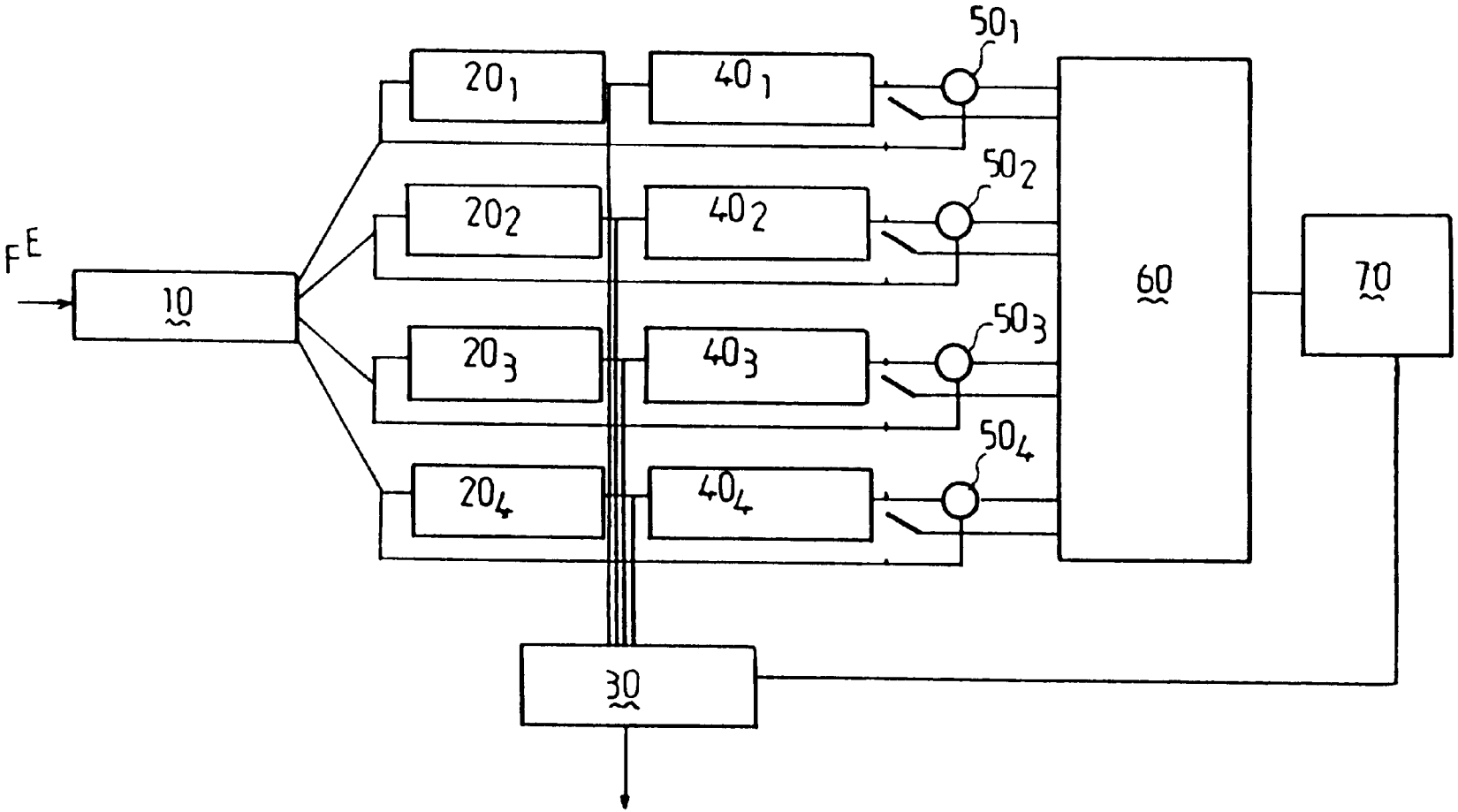
FIG. 1 is a schematic view of a coding system according to the invention.

The coding system shown in FIG. 1 is constituted by a filterbank 10 the input of which receives an in-coming audio-numerical flow FE to be coded. The filterbank 10 delivers several signals located in different sub-bands called primary sub-bands. These signals respectively are supplied to the inputs of low output primary coders $\mathbf{20}_1$ to $\mathbf{20}_4$, here four in number, but the number n of which may be any number higher than two. The output of each primary coder $\mathbf{20}_i$ (i=1 to n) is connected on one side to a corresponding input of a multiplexer 320 and, on the other side, to the input of a low delay primary decoder ($\mathbf{40}_i$ (i=1 to n). The output of each decoder $\mathbf{40}_i$ is connected to a first input of a subtractor $\mathbf{50}_i$ the other input of which receives the signal of the corresponding primary sub-band delivered by the filterbank 10. The difference signal coming from the subtractor $\mathbf{50}_i$ is supplied to the input of a secondary filterbank 60 the output of which is connected to a coder 70. The output of coder 70 is connected to a corresponding input of the multiplexer 30.

Figure 2:
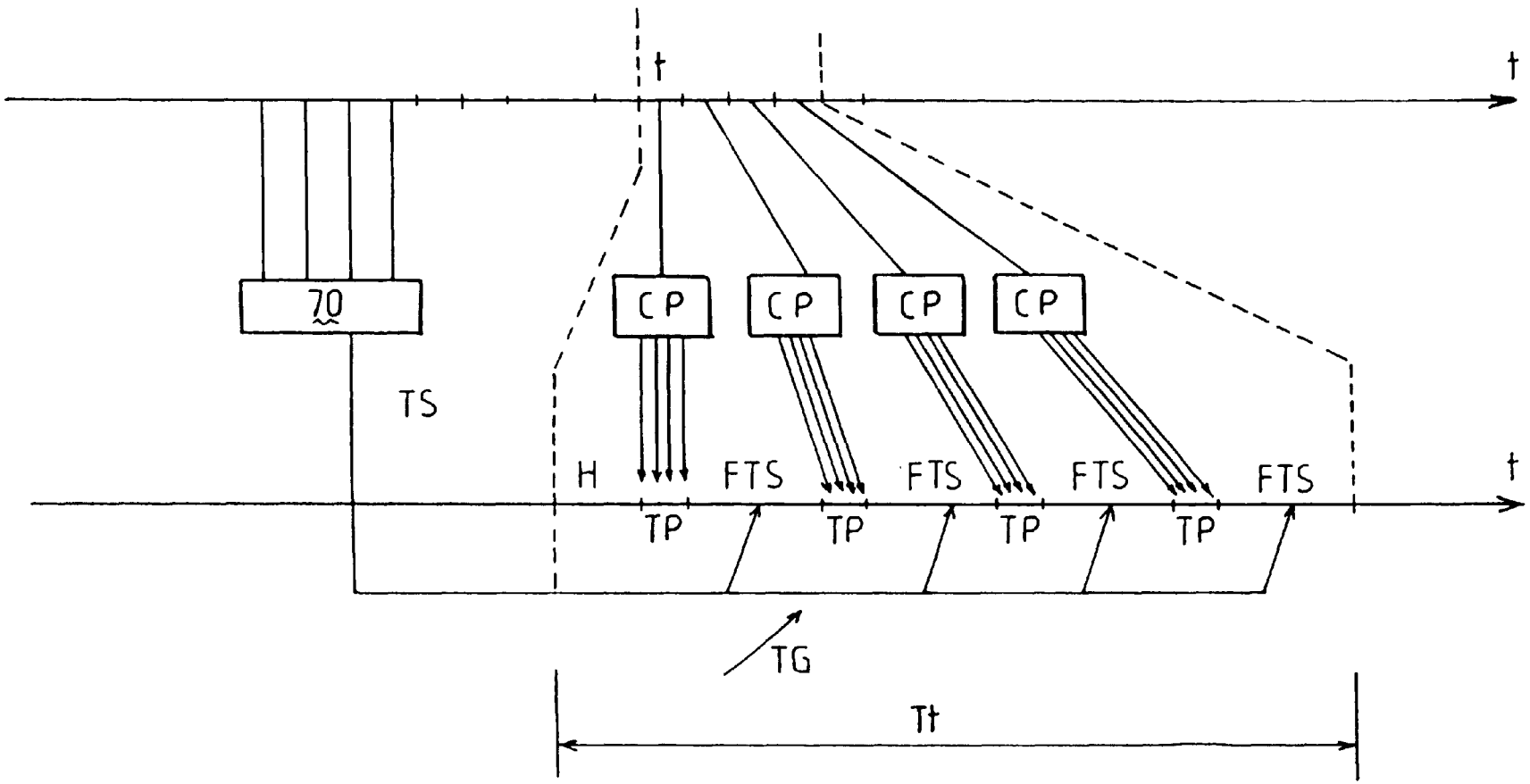
FIG. 2 illustrates the multiplexing process that is used in a coding system according to the invention.

Multiplexer 30 performs the interlacing of the primary and secondary flows respectively coming from the coders 20 and 70. FIG. 2 illustrates the interlacing process.

Two time-axes are shown, one of which is enlarged with respect to the second one, dotted lines showing the time correspondence between these axes. On the first axes there are represented segments the length of which corresponds to the duration of establishment t of a primary raster obtained by the association of the four primary flows having come from the coders $\mathbf{20}_1$ to $\mathbf{20}_4$. On the other axis, there is represented a global raster TG made up of a header H of four primary rasters TP and of four fragments of a secondary raster FTS, the secondary raster fragments FTS of secondary raster being the result of a fragmentation of the secondary raster TS delivered by the secondary coder 70. The number of bits of a fragment FTS is equal to the rate of flow assigned to the secondary flow multiplied by the duration t of transmission from the primary coders.

It can be seen that the duration Tt of the global raster TG is a whole multiple of the duration t of the primary raster mentioned above (here four of them). Likewise, the duration Tt of the global raster TG is a whole multiple of the duration T of the secondary raster TS. Advantageously, the duration of the global raster Tt is equal to the duration T of a secondary raster TS. In this case, a single secondary raster TS is included in the global raster TG, as is the case in FIG. 2.

It will be noted that the number of primary rasters TP and the number of fragments from the secondary rasters TS, per global, raster could be different from four, without basically changing the idea or design of the invention. Especially, this number is not bound to the number of sub-bands contained in a primary raster.

In order to decrease the coding/decoding delay, for the primary flow, the transmission of the global flow is done for all the durations of the primary rasters TP. More precisely, to each transmission there correspond the information of a primary raster TP and that of the consecutive secondary raster fragment FTS.

Over the duration Tt of the global raster, the binary flow allocated to each primary coder $\mathbf{20}_i$ is variable. This allocation is known by both the coding system and the decoding system. For example, it will be possible to decide on the allocation according to the energy in each primary sub-band.

The header H contains a synchronization word to set the decoding system and to deliver the allocations of the different primary coders $\mathbf{20}_i$. These allocations of raster headers transmitted by the coding system then serve to initialize the decoding system and to reduce possible errors of transmission.

For each sub-band of the filterbank 10, the filterbank 60 comprises an input to receive the affected sub-band delivered by the primary filterbank 10. From this signal, a suitable psycho-acoustical model, for example the first model proposed by the ISO/IEC 13818-3 standard, will determine the maximal levels of noise that can be audibly injected into each one of the secondary sub-bands.

The coder 70 is a perceptive coder the coding of which is based on the psycho-acoustical analysis supplied by the filterbank 60.

When the flow of the primary coder $\mathbf{20}_i$ has a sufficient number of bits available, for example 2.5 bits per sample, it is preferred to replace the original signal at the input of the filterbank for treatment according to the psycho-acoustical model, by its coded then decoded version delivered by the decoder $\mathbf{40}_i$ into the primary sub-band under consideration. The advantage is that the secondary decoder of the decoding system associated with the present coding system and that, therefore, is equipped with the same psycho-acoustical model as the filterbank 60, is capable of deducing the fine allocation levels computed by the secondary coder 70. In that case the costs of transmission are saved.

The primary filterbank may be a filterbank of the QMF family (Quadrature Mirror filterbank), or belong to the filterbanks of the MOT type (modulated orthogonal Transforms), with a number of sub-bands low enough so as not to cause too important a time delay. A modulated filterbank in sub-bands of uneven widths, or filterbank in cascade of the small-wave type, or others also may be considered, under condition that this choice be compatible with the delay imposed. A filterbank with eight sub-bands, modulated by a filter of length thirty-two, such as the one described by H. S. Makvar in an article titled "Extended Lapped Transforms: Properties, Applications, and Fast Algorithms" published in IEEE Transactions on signal processing, Vol. 40, No. 11, pp 2703,2714 of November 1992, is a good example of a filterbank adapted to the system of the invention.

Each low delay coder $\mathbf{20}_i$ may be a coder reconfigurable in flow, so that the flow associated with each sub-band will be variable. Each coder $\mathbf{20}_i$ generates a flow over a small number of grouped samples, that represent a constant duration independent of the sub-band. This duration hereafter will be called the primary duration. For example, it is possible to choose a coder of the LD-CELP (Low Delay—Code Excited Linear Prediction) type, such as that described by J. H. Chen et al in an article titled "A low delay CELP coder for the CCITT 16 kb/s speech coding standard" published in IEEE J. Sel. Areas Commun., Vol 10, pp 830–849 of June, 1992. This LD-CELP coder may contain a choice of dictionaries of different sizes.

With respect to each decoder $\mathbf{40}_i$, it will be noted that same could be included in the associated coder $\mathbf{20}_i$.

With respect to the secondary filterbank 60, its choice is freer than that of the primary filterbank 10, to the extent that no constraint is brought on the delay that it introduces. Such a filterbank can deliver a variable number of sub-bands per primary sub-band, and this depending on the stationary state of the signal in sub-band. Furthermore, in order to free oneself from the spectral coverings of the primary filterbank, it proves advantageous to use aliasing reduction covers (papillons), such as those described by B. Tang et al in an article titled "Spectral analysis of sub-band filtered signals" published in ICAASP, Vol 2, pp 1324–1327, 1995.

For example, in the case of a primary filterbank 10 with eight primary sub-bands, it is possible to choose for each one of the first four sub-bands, a filterbank of the MOT type (Modulated orthogonal Transforms) with means that permit, depending on the stationary state of the signal, the switching from a 128 or 32 lengths window, that respectively produces 64 or 32 sub-bands, and, for the other four primary sub-bands, a filterbank of the MOT type in 32 sub-bands of 64 length.

The available flow for the secondary coder 70 is computed by subtracting the rate of flow used by the low delay primary coders $\mathbf{20}_i$ from the total flow. For example, for a total flow of 64 kbits/s, it will be possible to allocate 32 kbits/s to the group of primary coders $\mathbf{20}_1$ to $\mathbf{20}_n$, and 32 kbits/s to the secondary coder 70.

Figure 3:
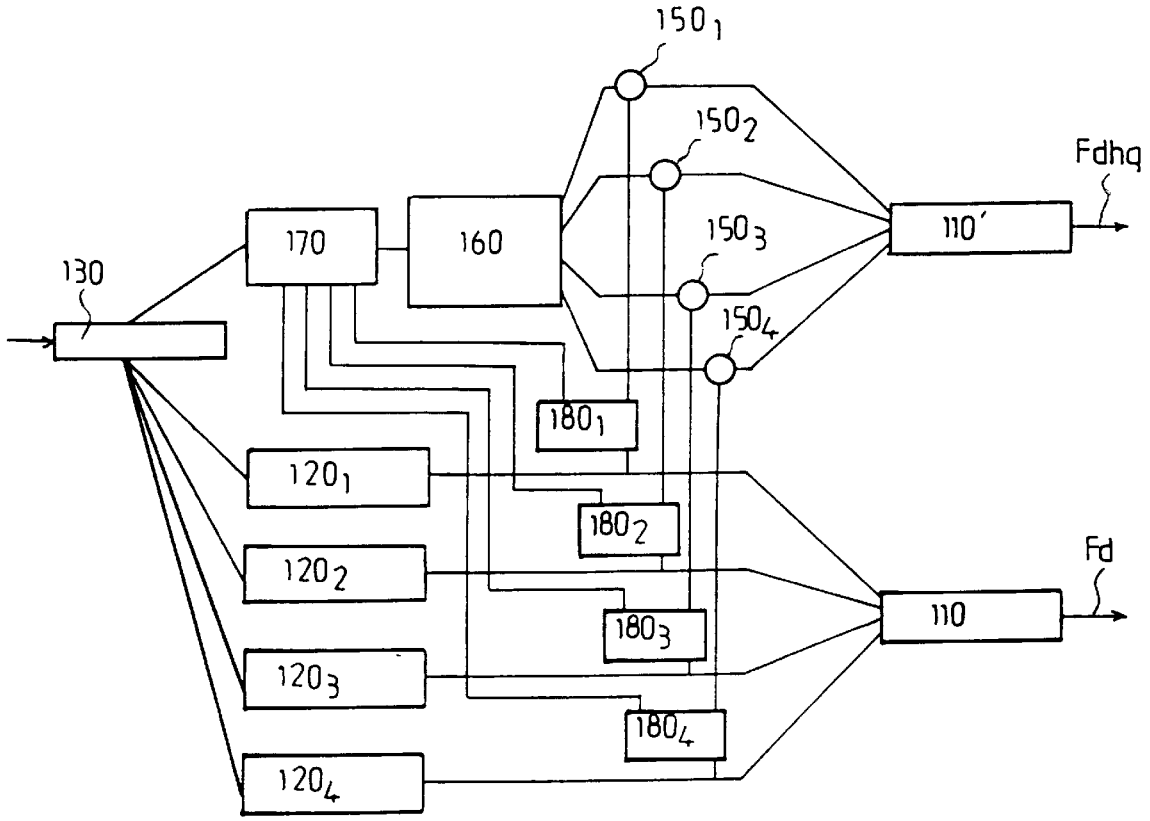
FIG. 3 is a schematic view of a decoding system according to the invention.

The decoding system shown in FIG. 3 is made up of elements the references of which range between 110 and 180. Each element is the dyad of an element of the coding system shown in FIG. 1 with the exception of elements $\mathbf{180}_i$. Its reference system then is the same, with one hundred added. As an example, the demultiplexer 130 is the dyad of the multiplexer 30.

In the present description, one element is the dyad of another element when it is provided to fulfill a function that is the reverse of this first element's function.

The decoding system shown in FIG. 3 is made up of a demultiplexer 130 the outputs of which respectively are connected to the inputs of primary decoders $\mathbf{120}_1$ to $\mathbf{120}_4$, and to a secondary decoder 170.

The output of each primary decoder $\mathbf{120}_1$ to $\mathbf{120}_4$ is connected on the one part to an associated delay line $\mathbf{180}_1$ to $\mathbf{180}_4$ and on the other part, to an input of a first primary filterbank 110. The output of filterbank 110 delivers the decoded primary flow Fd. The decoded primary flow Fd is the flow of lower quality but of low coding/decoding delay.

The output of each delay line $\mathbf{180}_1$ to $\mathbf{180}_4$ is connected to a first input of a corresponding adder $\mathbf{150}_1$ to $\mathbf{150}_4$.

The output of secondary decoder 170 is connected to the input of a filterbank 160 the outputs of which respectively are connected to the second inputs of the adders $\mathbf{150}_1$ to $\mathbf{150}^{24}$.

Finally, the outputs of the adder $\mathbf{150}_1$ to $\mathbf{150}_4$ are respectively connected to the corresponding inputs of a filterbank 110 the output of which delivers the high quality decoded flow Fdhq.

A connection between each delay line $\mathbf{180}_i$ and the decoder 170 is provided so as to transmit to the latter, at the desired time, the information of allocations present in the primary flow coming from the corresponding decoder $\mathbf{120}_i$.

The demultiplexer 130 of the decoding system performs the separation of the global raster TG received, into primary rasters TP and into a secondary raster, alternately delivered to the primary decoders $\mathbf{120}_1$ to $\mathbf{120}_4$ and to the secondary decoder 170. The low delay output of the decoding system is obtained by the decoding, in the primary decoders $\mathbf{120}_i$, of the primary rasters into sub-bands, then by their passage through the filterbank 110 that is the reciprocal of the low delay filterbank 10. In each one of the sub-bands, the primary flow issued from the primary decoders $\mathbf{120}_i$, as well as the allocation information it contains, are sent into the corresponding delay line $\mathbf{180}_i$ to feed the high quality part. The information regarding allocations, issued from the delay lines are transmitted, for each primary flow, to the secondary decoder 170 that executes then a decoding of the secondary raster. There are then applied the aliasing reduction covers (papillons) that are the reciprocal of the coding covers (papillons), then the secondary filterbank 160. There are then added the signals received from the primary decoders $\mathbf{120}_i$, via the delay lines $\mathbf{180}_i$ to feed the primary filterbank $\mathbf{110}'$. The high quality signal Fdhq is recovered at the output.

What is claimed is:

1. System for the coding of a signal to be coded, of the type that delivers a global flow made up of a primary flow that corresponds to a coding of the input flow, called primary coding, and of a secondary flow corresponding to a secondary coding, the coding delay of said primary coding being inferior to that of the secondary coding, characterized in that it comprises a filterbank (10) provided to receive said input flow (FE) to be coded and to develop signals in different bands, respectively, coders called primary coders ($\mathbf{20}_1$ to $\mathbf{20}_4$) to code said signals into sub-bands, respectively and thus form primary flows (TP), decoders ($\mathbf{40}_1$ to $\mathbf{40}_4$) that receive said primary flows (TP) and that decode these flows, subtractors ($\mathbf{50}_1$ to $\mathbf{50}_4$) each one of which is provided to perform the difference between the signals delivered by the filterbank (10) into each sub-band and the signals delivered by the corresponding decoder ($\mathbf{40}_1$ to $\mathbf{40}_4$), a coder 70 called secondary coder, to perform the coding of the signals issued from the subtractors ($\mathbf{40}_1$ to $\mathbf{40}_4$), and thus to develop a secondary flow (TS), and a multiplexer (30) to multiplex into a single global flow (TG) the primary flows (TP) issued from the primary coders ($\mathbf{20}_1$ to $\mathbf{20}_4$) and the secondary flow (TS) issued from the secondary coder (70).

2. Coding system according to claim 1, characterized in that it comprises a second filterbank (60), called secondary filterbank that receives on each one of its inputs the difference signal issued from each subtractor ($\mathbf{50}_1$ to $\mathbf{50}_4$), and that delivers a filtered flow to the input of the secondary coder (70).

3. Coding system according to claim 2, characterized in that said secondary filterbank (60) comprising, for each sub-band, an input to receive the primary flow (TP) issued from the primary coder ($\mathbf{20}_1$ to $\mathbf{20}_4$) and decoded by the corresponding decoder ($\mathbf{40}_1$ to $\mathbf{40}_4$) (sic) in order to determine, by means of a psycho-acoustical model, the maximal levels of noise that can be injected into each one of the sub-bands, said secondary coder (70) being a perceptive coder the coding of which is based on the psycho-acoustical analysis performed by said secondary filterbank (60).

4. Coding system according to claim 2, characterized in that said secondary filterbank (60) comprising, for each sub-band, an input to receive the signal in sub-band form issued from the primary filterbank (10) in order to determine, by means of a psycho-acoustical model, the maximal levels of noise that can be injected into each one of the sub-bands, said secondary coder (70) being a perceptive coder the coding of which is based on the psycho-acoustical analysis performed by said secondary filterbank (60).

5. Coding system according to one of claims 1 to 4, Characterized in that each primary coder ($\mathbf{20}_i$ to $\mathbf{20}_4$) is a coder the flow of which can be reconfigured.

6. A system for the decoding of a flow coded by a coding system according to one of claims 1 to 4, characterized in that it comprises a flow demultiplexer (130) that delivers a plurality of primary flows and a secondary flow, a plurality of primary decoders ($\mathbf{120}_1$ to $\mathbf{120}_4$) to decode said primary flows, the output of each decoder ($\mathbf{120}_1$ to $\mathbf{120}_4$) being connected to a corresponding input of a primary filterbank (110) that delivers, then, a low delay decoded flow (Fd), the output of each decoder ($\mathbf{120}_1$ to $\mathbf{120}_4$) being also connected to an input of a corresponding delay line ($\mathbf{180}_1$ to $\mathbf{180}_4$) the output of which is connected to the first input of a summing-up device ($\mathbf{150}_1$, to $\mathbf{150}_4$), a secondary decoder (170) delivering a decoded secondary flow supplied to a second input of each summing-up device ($\mathbf{150}_1$ to $\mathbf{150}_4$), the output of each summing-up device ($\mathbf{150}_1$ to $\mathbf{150}_4$) being connected to the input of a second primary filterbank ($\mathbf{110}'$) to deliver a high quality decoding flow (Fdhq).

7. Decoding system according to claim 6, characterized in that it further comprises a secondary filterbank (160).

8. Process for multiplexing a primary raster (TP) with a secondary raster (TS), booth of them developed by a system for the coding of a signal to be coded, of the type that delivers a global flow made up of a primary flow corresponding to a coding of an input flow, called primary coding, and of a secondary flow corresponding to a secondary coding, characterized in that it consists in forming a raster called global raster (TG) made up by the concatenation of a plurality of primary rasters (TP) and of a plurality of fragments (FTS) of at least one secondary raster (TS), one primary raster (TP) alternating with one fragment of a secondary raster (FTS), the number of bits of a secondary raster fragment (FTS) being equal to the rate of flow allocated to the secondary flow (TS) multiplied by the duration of transmission of a primary raster (TP).

9. A multiplexing process according to claim 8, characterized in that the transmission of the global rasters (TG) is done for every duration of the primary rasters (TP).

10. A multiplexing process according to claim 8 or 9, characterized in that the duration of a global raster (TG) is equal to the transmission duration of a primary raster (TP) multiplied by the number of primary rasters (TP).

* * * * *